United States Patent [19]

Silverstein et al.

[11] Patent Number: 4,467,238

[45] Date of Patent: Aug. 21, 1984

[54] HIGH-PRESSURE SODIUM LAMP WITH IMPROVED IR REFLECTOR

[75] Inventors: Seth D. Silverstein; Jerome S. Prener, both of Schenectady, N.Y.

[73] Assignee: General Electric Company, Schenectady, N.Y.

[21] Appl. No.: 298,836

[22] Filed: Sep. 3, 1981

[51] Int. Cl.[3] ..... H01J 61/34; H01J 61/38

[52] U.S. Cl. ..... 313/25; 313/113; 313/635

[58] Field of Search ..... 313/25, 27, 635, 634, 313/489, 113, 110, 114

[56] References Cited

U.S. PATENT DOCUMENTS

| | | | |
|---|---|---|---|
| 3,221,198 | 11/1965 | Van Der Wal et al. | 313/27 |
| 3,400,288 | 9/1968 | Groth | 313/47 |
| 3,662,203 | 5/1972 | Kuhl et al. | 313/25 |
| 3,931,536 | 1/1976 | Fohl et al. | 313/113 |
| 3,949,259 | 4/1976 | Kostlin et al. | 313/112 |
| 4,017,758 | 4/1977 | Almer et al. | 313/112 |

FOREIGN PATENT DOCUMENTS

| | | |
|---|---|---|
| 1305065 | 1/1973 | United Kingdom . |
| 1562929 | 3/1980 | United Kingdom . |
| 2035679 | 6/1980 | United Kingdom . |
| 1579624 | 11/1980 | United Kingdom . |

OTHER PUBLICATIONS

Liu, C. S., "Heat Conservation System for Arc Lamps", Jr. of IES, Jul. 1979, pp. 220–225.

Waymouth, J. F. et al., "Analysis of Factors Affecting Efficacy of High Pressure Sodium Lamps", Jr. of IES, Jul. 1981, pp. 237–244.

*Primary Examiner*—David K. Moore

*Assistant Examiner*—K. Wieder

*Attorney, Agent, or Firm*—Geoffrey H. Krauss; James C. Davis, Jr.; Marvin Snyder

[57] ABSTRACT

The efficacy of a high-pressure sodium lamp is increased significantly by enlarging the arc tube diameter and deploying a composite infrared-reflective film on the interior of the outer lamp envelope. The infrared-reflective film acts to maintain the wall temperature of the enlarged arc tube at the same optimum temperature as the arc tube wall in a conventional high-pressure sodium lamp. In one embodiment, the IR reflective film is a multi-layer composite film of $In_2O_3$:Sn or $SnO_2$:F overcoated with a $TiO_2$ or $SiO_2$ dielectric film. In another embodiment, a three-layer composite film is made up of $TiO_2$, $In_2O_3$:Sn, or $SnO_2$:F, and $SiO_2$ films sequentially overlaid on the outer envelope. The dielectric films improve lamp efficacy and enhance the high temperature chemical stability of $In_2O_3$:Sn and $SnO_2$:F. Such IR reflective films are substantially transparent to radiation in the visible region of the spectrum, but are highly reflective in the infrared portions of the spectrum.

22 Claims, 5 Drawing Figures

HIGH-PRESSURE SODIUM LAMP WITH IMPROVED IR REFLECTOR

BACKGROUND OF THE INVENTION

This application is related to copending applications Ser. No. 298,838, P. D. Johnson and S. D. Silverstein and Ser. No. 298,837, S. D. Silverstein, both filed on the same date as the present application and assigned to the same assignee as the present invention.

This invention relates to high-pressure sodium lamps. More specifically, the invention relates to improvement of high-pressure sodium lamp efficacy through the combined effect of increased arc tube diameter and use of improved IR reflective film to maintain arc tube wall temperature in the optimum range.

A high-pressure sodium lamp generally comprises an inner arc tube disposed within an outer protective envelope and which contains the conventional ionizable medium of sodium, mercury, and an inert gas to facilitate start-up. As current is passed through the electrodes located at each end of the arc tubes, the inert gas ionizes and forms an arc between the electrodes. The sodium vaporizes due to the heat of the arc. Optimum operating arc tube wall temperature of such lamps is in the range of 1400° K. to 1500° K. The arc tube diameter of a conventional 400 watt high pressure sodium lamp is approximately 7 millimeters.

An important consideration in the design of high-pressure sodium lamps is the "wall load" parameter, defined as power per unit area. In practical terms the "wall load" is measured by dividing the lamp power input by the area of the interior surface of the arc discharge tube. The importance of the wall loading is due to its significant effect on arc tube wall temperature, which, in turn, is closely related to lamp efficacy (measured in lumens/watt). Hence, the desirability of maintaining a predetermined optimal arc tube wall temperature in a high pressure sodium lamp is quite apparent.

J. F. Waymouth and E. F. Wyner have demonstrated, as described in a paper presented at the annual meeting of the IES (August 1980), that the efficacy of a high-pressure sodium lamp is improved with increased arc tube diameter at constant arc tube wall temperatures. In a conventional high-pressure sodium lamp, a significant fraction of the energy input to the lamp is dissipated as long wavelength IR radiation from the incandescence of the heated alumina ($Al_2O_3$) arc tube. However, since the thermal radiation heat transfer is proportional to the area of the arc tube, a larger diameter arc tube (hence, one with a greater area) radiates even more heat. Unless steps are taken to recover the radiated heat, the arc tube wall temperature will fall below the optimum temperature range and more energy must be supplied to the lamp to raise arc tube wall temperature. Moreover, as the sodium concentration is inversely proportional to arc tube wall temperature, the cooler wall temperature will result in a greater reabsorption of the main sodium emission line (NaD) and a lowering of lamp efficacy. The method proposed by Waymouth and Wyner to maintain the arc tube wall temperature of a larger diameter arc tube in the optimum range involves the substitution of yttria ($Y_2O_3$) for alumina as the arc tube material (yttria having lower emissivity than alumina, especially in the infrared region of the spectrum).

In accordance with the present invention, the efficacy of a high-pressure sodium lamp having a larger-than-conventional arc tube diameter is increased by deploying a composite IR reflective film made up of indium oxide doped with tin ($In_2O_3$:Sn) or tin oxide doped with fluorine ($SnO_2$:F) in combination with dielectric films of titanium oxide ($TiO_2$) and/or silicon oxide ($SiO_2$) on the inner surface of the outer lamp envelope. The IR reflective film is substantially transparent to visible radiation but acts to reflect infrared radiation toward the arc tube which would otherwise be lost. A substantial fraction of IR emission from the arc is reflected back into the plasma contained within the arc tube where it is reabsorbed, resulting in the reduction of required input power. $TiO_2$ and $SiO_2$ dielectric films in combination with $In_2O_3$:Sn or $SnO_2$:F films can decrease the reflectivity of the IR reflective film at the visible wavelengths and increase reflectivity in the near-visible IR wavelengths. The dielectric films also enhance the chemical stability of the IR reflective film at high temperature. In this manner, the arc tube wall temperature is effectively and efficiently maintained in the optimum range.

In the past, IR reflective films have been used with low-pressure sodium lamps as a means to improve efficacy. U.S. Pat. No. 3,400,288 to Groth is illustrative of such lamps. The principle of operation of a low-pressure sodium lamp, however, is unlike that of a high-pressure sodium lamp. Consequently, the mechanism for increasing the efficacy in the low-pressure sodium lamp is also different from that of high-pressure sodium lamp. In the low-pressure sodium lamp, the efficacy increase is a result of the increase in sodium vapor pressure at constant input power due to higher wall temperature. In contrast, the efficacy increase in the high-pressure sodium lamp of the present invention is due to combined effects of: increased arc tube diameter, the use of composite IR reflective film to maintain optimum wall loading, and to reflect part of the nonvisible emission from the plasma back into the plasma. Moreover, increasing the arc tube diameter of a low-pressure lamp is not accompanied by changes in efficacy such as those observed in high-pressure sodium lamps.

U.S. Pat. Nos. 3,931,536 and 3,662,203 to Fohl et al and Kuhl et al, respectively, disclose high-pressure sodium lamps including IR reflective films. The patent to Fohl et al discloses a reflective film made up of alternate layers of titanium oxide ($TiO_2$) and silicon oxide ($Si_2O$). One such reflector consists of thirteen quarter-wave alternate layers of $TiO_2$ and $SiO_2$ sandwiched between eighth-wave layers of $SiO_2$. As may be seen, such a reflector is significantly more complex than the composite IR reflective film employed in the present invention. Kuhl et al proposes additional heating of the arc tube by positioning the outer envelope in very close proximity to the arc tube. The outer envelope, composed of highly refractive quartz, reradiates arc heat back to a quartz arc tube. The method disclosed by Kuhl et al, thus, not only employs a relatively expensive quartz outer envelope, but the reduced surface area of the outer envelope might result in the undesirable overheating of any reflective films deployed on the outer envelope. Moreover, neither Fohl et al nor Kuhl et al show any appreciation of the desirable effect on the efficacy of a high-pressure sodium lamp of increased arc tube diameter and IR reflective $In_2O_3$:Sn or $SnO_2$:F film.

SUMMARY OF THE INVENTION

The efficacy of a high-pressure sodium lamp is improved by simultaneously increasing the diameter of the arc tube and deploying a composite IR reflective film made up of such semiconductor oxides as $In_2O_3$:Sn or $SnO_2$:F and dielectrics such as $TiO_2$ and $SiO_2$ on the inner surface of the outer lamp envelope. The semiconductor oxide and dielectric films act to reflect to the plasma and arc tube IR energy which would ordinarily be either absorbed or transmitted directly through the outer envelope. The dielectric materials also aid in enhancing the chemical stability of semiconductor oxide films at high temperature. For example, overcoating semiconductor oxide $In_2O_3$:Sn or $SnO_2$:F films with $TiO_2$ results in increased stability of the semiconductor oxide material but with no net increase in the efficacy of the high-pressure sodium lamp over that obtained with a single semiconductor oxide film. The efficacy of the high-pressure sodium lamp, however, is increased over that obtained with a single semiconductor oxide fim and the chemical stability of the semiconductor oxide film enhanced by overcoating, for instance, a 150 nanometer thick $In_2O_3$:Sn film with a 120 nanometer thick $SiO_2$ film. A three-layer composite film comprised of $In_2O_3$:Sn disposed between a $TiO_2$ substrate and an $SiO_2$ overcoat provides an even greater increase in efficacy than that obtained with a single semiconductor film or such film overcoated with a single coat of $SiO_2$. In a preferred embodiment of the three-layer $TiO_2$-$In_2O_3$:Sn-$SiO_2$ composite, the film thicknesses are 130-150-120 nanometers, respectively. Generally, optimum thickness ranges of $TiO_2$ and $SiO_2$ dielectric films may vary by $\pm 10$ nanometers, respectively. In this manner, the arc tube wall temperature is maintained in the optimum range of 1400° K. to 1500° K. in an arc tube having a larger-than-conventional diameter. The thickness of the semiconductor oxide film may be between 80 and 350 nanometers, but is preferably between 130 and 200 nanometers for $In_2O_3$:Sn and between 130 nm and 250 nm for $SnO_2$:F. The arc tube diameter is preferably between 10 and 14 millimeters and most preferably between 12 and 14 millimeters but may be as high as 25 millimeters.

The $In_2O_3$:Sn film may be deposited on glass using an open-air-chemical spray-annealing technique. The dielectric films may be deposited by a variety of methods. Amorphous $SiO_2$ may be deposited using conventional low temperature hydrolysis of silicon compounds such as silicon halides and organic silicate esters. $TiO_2$ may be deposited at low temperature by hydrolysis of $TiCl_4$.

It is an object of the invention to increase the efficacy of a high-pressure sodium lamp, and enhance high temperature chemical stability of IR reflective semiconductor oxide thin films.

It is another object of the invention to increase the efficacy of a high-pressure sodium lamp by increasing arc tube diameter and deploying an improved composite IR reflective film made up of semiconductor oxide thin film and dielectric films on the inner surface of the outer envelope in order to maintain arc tube wall temperature in the optimum range.

It is still another object of the invention to provide a highly efficient high-pressure sodium lamp having a larger-than-conventional diameter arc tube and $In_2O_3$:Sn or $SnO_2$:F semiconductor oxide thin film overcoated with or sandwiched between $TiO_2$ and $SiO_2$ dielectric film deployed on the outer lamp envelope to thereby maintain arc tube wall temperature in the optimum range.

BRIEF DESCRIPTION OF THE DRAWINGS

The features of the invention believed to be novel are set forth with particularity in the appended claims. The invention itself, however, both as to its organization and method of operation, together with further objects and advantages thereof, may best be understood by reference to the following description taken in conjunction with the accompanying drawings in which:

DETAILED DESCRIPTION OF THE INVENTION

Figure 1:
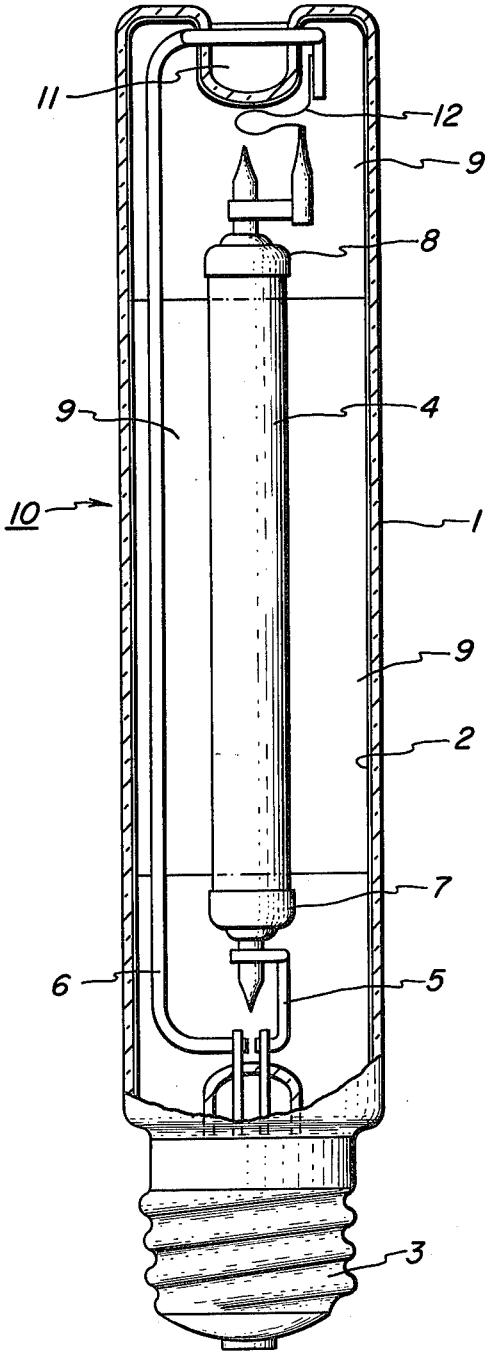
FIG. 1 illustrates an embodiment of a high-pressure sodium lamp including an IR reflective film deployed on the inner surface of the outer envelope.

FIG. 1 illustrates an embodiment of a high-pressure sodium lamp 10 of the present invention. The lamp comprises an outer glass envelope 1 having a composite IR reflective film 2 (described more fully hereinafter) preferably deployed in the inner surface thereof. A conventional ionizable discharge medium, including sodium, is contained within an arc discharge tube 4 mounted within outer envelope 1 with the aid of electrodes 5 and 6 which are electrically connected to conductive arc tube end caps 7 and 8, respectively. Mechanical support for electrode 6 is provided by dimple 11 in outer envelope 1 around which the electrode is partially wrapped. Flexible member 12 mechanically and electrically connects electrode 6 to end cap 8 and provides compensation for thermal expansion. The inner diameter of arc tube 4 may be between 10 millimeters and 25 millimeters, preferably between 10 and 14 millimeters, but most preferably is between 12 millimeters and 14 millimeters. The diameter of arc tube 2 is also dependent on the power rating of the lamp. For a conventional 400 watt high-pressure sodium lamp, arc tube diameter is approximately 6 to 7 millimeters. Lamp 10 may also be provided with a conventional screw-in Edison-type base 3. Space 9 between arc tube 4 and the outer envelope 1 may be filled with an inert gas such as argon, but in the preferred embodiment is evacuated.

Composite reflective film 2 may comprise heavily tin doped semiconductor oxide $In_2O_3$, or $SnO_2$ doped with fluorine, having a thickness ranging from 80 nanometers to 350 nanometers, and is overcoated with a 120 nanometer thick dielectric film of $TiO_2$ or $SiO_2$. In an alternative embodiment, reflective film 2 is made up of a semiconductor oxide film disposed on a $TiO_2$ film substrate and overcoated with a film of $SiO_2$. In this embodiment, the respective film thicknesses of the $TiO_2$-semiconductor oxide-$SiO_2$ composite are 130, 150, 120 nanometers, respectively. For optimal results, thickness ranges of the $TiO_2$ and $SiO_2$ dielectric films are 130 and 120 nanometers, ±10 nanometers, respectively. The preferable range of $In_2O_3$:Sn and $SnO_2$:F film thickness is between 130 nm and 200 nm and between 130 and 250 nm, respectively.

$In_2O_3$:Sn and $SnO_2$:F films may be produced on the inner or outer surfaces of the outer lamp envelope by conventional open air chemical spray techniques. The semiconductor material is sprayed onto glass substrates heated to 400° C. or higher. $SiO_2$ films may be deposited by low-temperature hydrolysis of silicon compounds such as silicon halides and organic silicate esters. $TiO_2$ films may be deposited at low temperature by hydrolysis of $TiCl_4$, for example.

Figure 2:
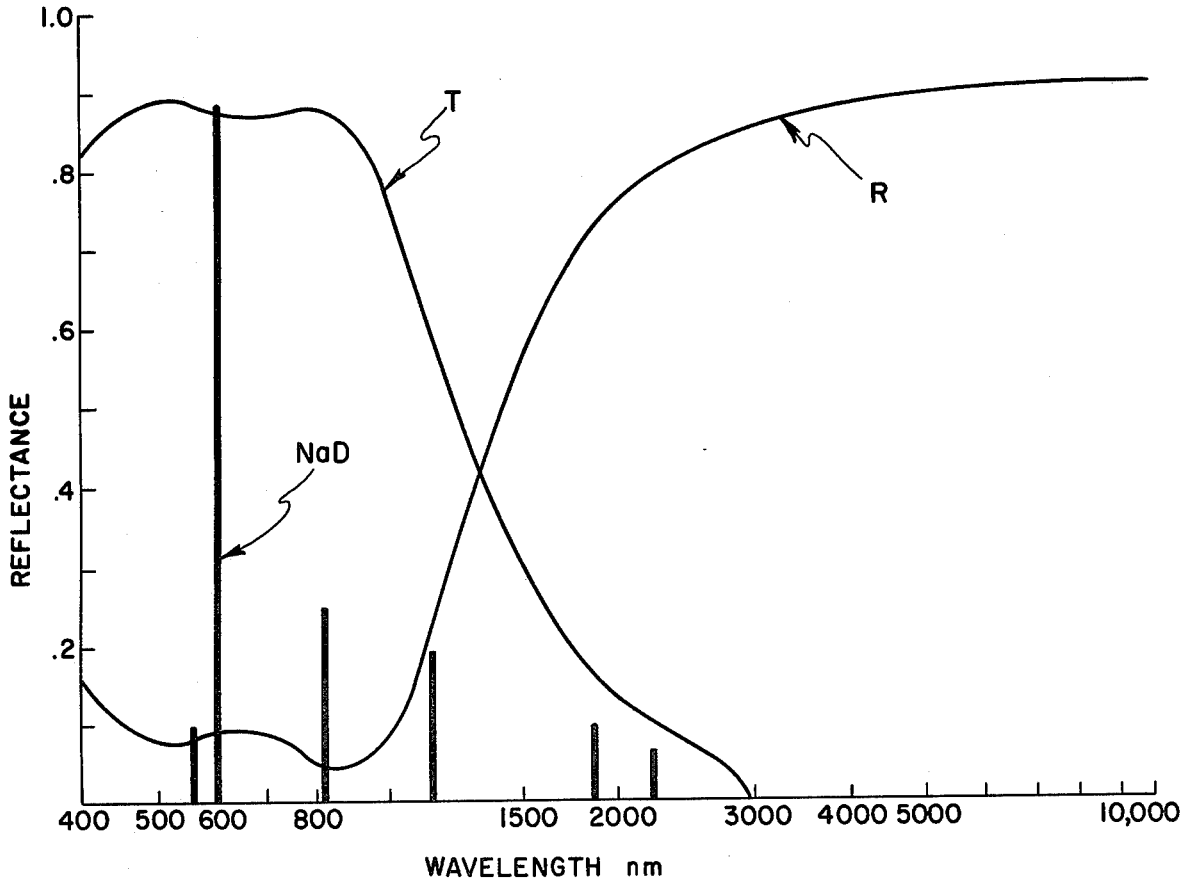
FIG. 2 depicts the wavelengths of energy emission lines of the high-pressure sodium lamp and the spectral reflectance and transmittance of a 150 nanometers thick $In_2O_3$:Sn film deployed on glass.

FIG. 2 illustrates the spectral transmittance (T) and reflectance (R) of a single $In_2O_3$:Sn film 150 mm thick with a free-carrier concentration of $1.3\times10^{21}$ $cm^{-3}$. The line emissions from a high-pressure sodium arc (with the heights corresponding to relative strengths) are shown along the horizontal axis. The fraction of transmitted or reflected emissions are indicated on the vertical axis. It may be observed in FIG. 2 that the $In_2O_3$:Sn film is highly reflective in the 1000 to 3000 nm region and has a low absorptance in the visible spectrum region which includes the main sodium emission line (NaD) in the region of 600 nm. The average visible absorptance of the $In_2O_3$:Sn film-glass composite is approximately 0.03. It should be noted that the visible portion of the spectum illustrated in FIG. 2 extends to approximately 700 nm, while the near-infrared region extends from 700 nm to approximately 1000 nm. The discrete sodium IR emissions arising from excited atomic states appear at 1100 nm, 1850 nm, and 2100 nm. These emissions are partially reflected back toward the arc tube and into the plasma where they are partially reabsorbed resulting in an input power reduction. The reflective film also reflects back toward the arc tube continuum IR emissions arising primarily from the recombination of ionized $Na_2$ molecules and, to some extent, radiation from sodium-mercury molecular complexes, thereby further improving lamp efficacy.

The use of a single $In_2O_3$:Sn 150 nanometer thick reflective film in combination with an arc tube having an increased arc tube diameter results in substantial improvement in high-pressure sodium lamp efficacy. Part of the efficacy increase is the result of the increased arc tube diameter. An additional increase results from the partial reflection and absorption of the plasma IR emission attributable to the IR reflective effect of the $In_2O_3$:Sn. The use of the IR reflective film provides a significant contribution to the improvement of lamp efficacy, especially when it is considered that in a conventional high-pressure sodium lamp, approximately 35 percent of the energy input to the lamp is dissipated as long wavelength IR radiation from the incandescence of the heated alumina arc tube.

Figure 3:
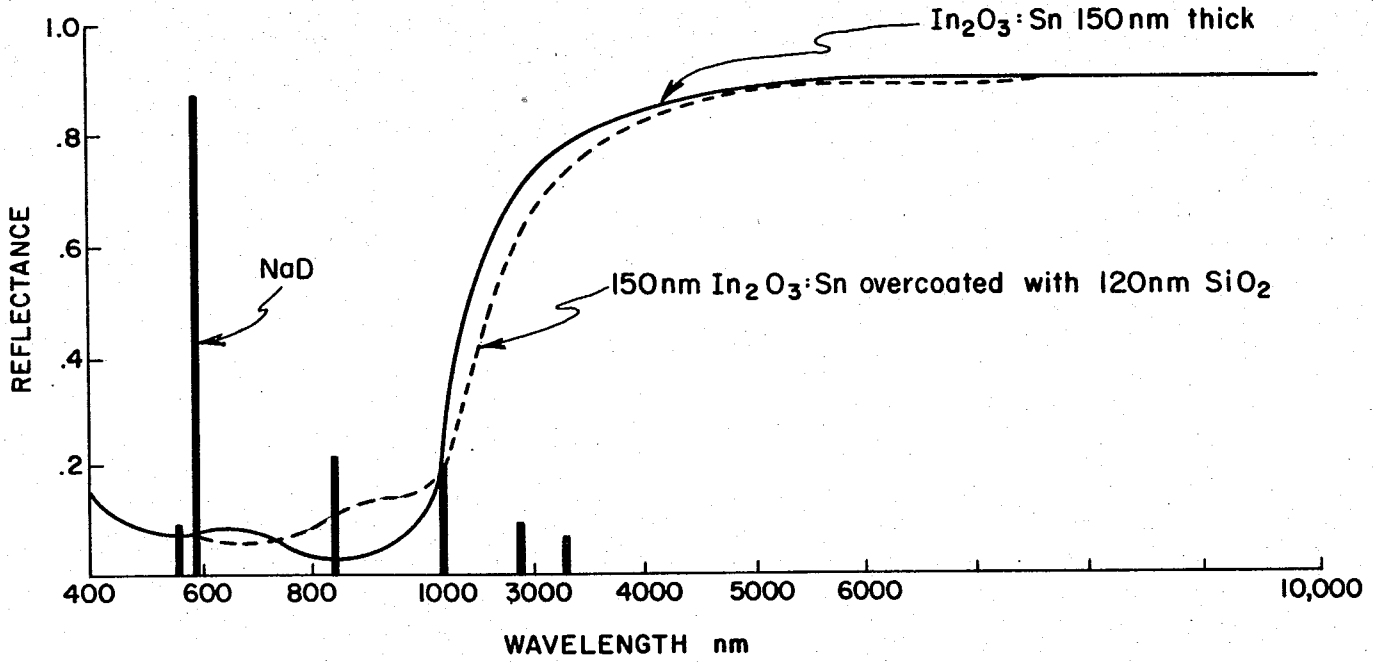
FIG. 3 illustrates the spectral reflectance of a single 150 nm thick layer of $In_2O_3$:Sn on a glass substrate and the spectral reflectivity of the same film overcoated with a 120 nm thick film of $SiO_2$.
Figure 4:
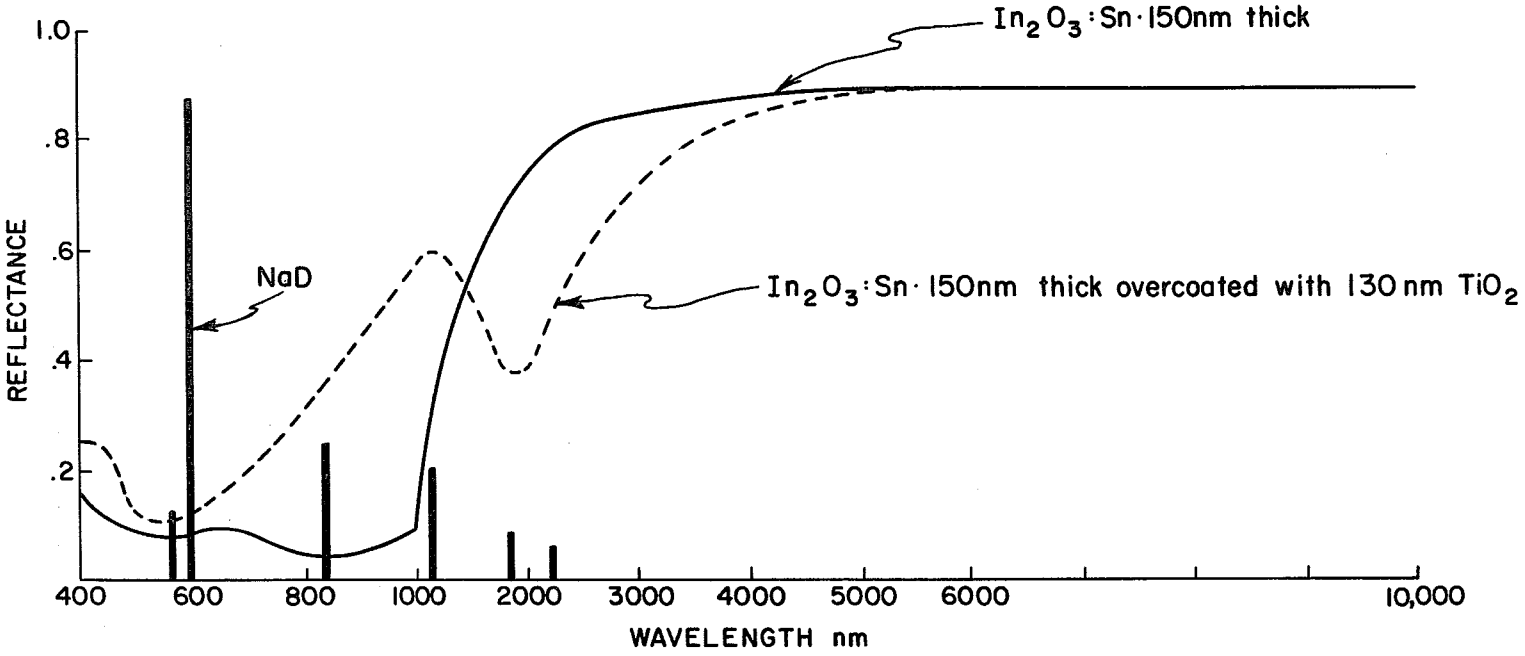
FIG. 4 is similar to FIG. 3, but shows the spectral reflectivity of the $In_2O_3$:Sn film overcoated with a 120 nm thick film of $TiO_2$.

The spectral reflectivity of a single 150 nanometer thick $In_2O_3$:Sn film overcoated with a 120 nanometer thick film of $SiO_2$ is shown in FIG. 3, which also shows for ease of comparison the spectral reflectance of the single 150 nanometer $In_2O_3$:Sn film. It may be observed that for the overcoated $In_2O_3$:Sn film the reflectivity is reduced slightly in the visible region associated with the pressure broadened NaD line, and is increased in the vicinity of the 819 nm (near-infrared) sodium emission line. Both of these effects act to enhance the efficacy of the composite film over that which would be obtained by an $In_2O_3$:Sn film alone. FIG. 4 depicts the spectral reflectivity of an $In_2O_3$:Sn film similar to that shown in FIG. 3, but overcoated with a 120 nanometer thick film of $TiO_2$. In this embodiment there is no net increased in efficacy over that obtained with a single $In_2O_3$:Sn film because the gain in reflection from the 819 nm emission line will be lost due to a decrease in transmittance at the NaD emission line. The $TiO_2$ overcoat, however, enhances the high temperature chemical stability of the $In_2O_3$:Sn film.

Figure 5:
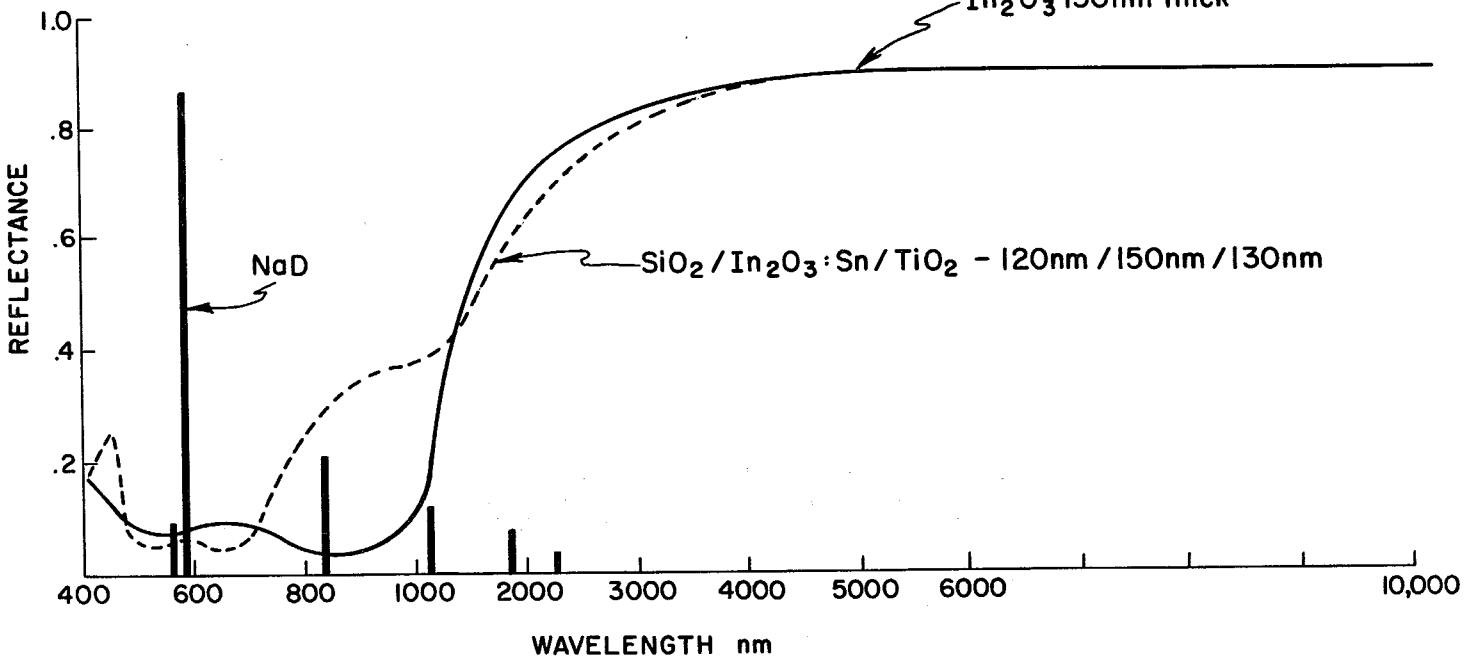
FIG. 5 depicts the spectral reflectivity of a three-layer $TiO_2$-$In_2O_3$:Sn-$SiO_2$ composite system wherein film thicknesses are 130/150/120 nm, respectively.

The reflectivity of a preferred embodiment of a three-layer composite film made up of a 150 nanometer $In_2O_3$:Sn film deposited on a 130 nanometer thick $TiO_2$ film substrate and overcoated with a 120 nanometer thick $SiO_2$ film is shown in FIG. 5. Comparison with the reflectivity of a single $In_2O_3$:Sn 150 nanometer thick film depicted in FIG. 5 indicates the increased reflectance at the near-infrared 819 nm sodium line and a decreased reflectivity at the visible NaD line. It is estimated that the three-layer composite film provides an efficacy increase of approximately 4 percent over that obtained with a single $In_2O_3$:Sn film. Due to increased reflectivity in the 819 nm region of sodium emission, the three-layer composite film also provides a greater efficacy increase than that obtained with a single $SiO_2$ overcoat layer.

With each of the aforedescribed IR reflective films, the outer envelope should be made sufficiently large to avoid damage to the film due to excessive heat.

It will be appreciated from the foregoing that the present invention provides significant improvement in the efficacy of a high-pressure sodium lamp and the enhancement of the high temperature chemical stability of IR reflective semiconductor oxide thin films. Semiconductor oxide films in combination with $TiO_2$ and $SiO_2$ dielectric films enable economical and efficient recovery of IR radiation, which is then advantageously reflected to an increased diameter arc tube, thereby maintaining the arc tube wall temperature in the optimum range. The efficacy of a high pressure sodium lamp employing an enlarged arc tube diameter together with the improved reflective films described herein is increased over that of a similar lamp using a single $In_2O_3$:Sn or $SnO_2$:F film.

While certain preferred features of the invention have been shown by way of illustration, many modifications and changes will occur to those skilled in the art. It is, therefore, to be understood that the appended claims are intended to cover all such modifications and changes as fall within the true spirit of the invention.

The invention claimed is:

1. A high-pressure sodium lamp, comprising:

an elongate, visible-light-transmissive, pressurizable alumina arc tube having electrodes disposed at the opposite ends thereof for establishment of an ionization discharge therebetween, said arc tube having an inside diameter between 10 millimeters and 25 millimeters;

an atomic sodium metal specie disposed in said arc tube, said sodium metal specie upon excitation responsive to said discharge emitting energy in the visible and infrared wavelengths of the electromagnetic spectrum;

an evacuable, outer glass envelope surrounding said arc tube and having an interior surface facing said arc tube; and a composite IR reflective film deposited upon said interior surface of said outer envelope and consisting of a single layer of each of $TiO_2$, $In_2O_3$:Sn, and $SiO_2$ films sequentially overlaid on said interior surface of said outer glass envelope, said composite film transmitting a substantial portion of said visible wavelength energy and reflecting toward said arc tube a substantial portion of said infrared wavelength energy which is absorbed by said arc tube in an amount sufficient to maintain the wall temperature of said arc tube in an optimum temperature range.

2. The lamp of claim 1, wherein said $In_2O_3$:Sn film has a thickness of between 80 nanometers and 350 nanometers.

3. The lamp of claim 1, wherein said $In_2O_3$:Sn film has a thickness of between 130 nanometers and 200 nanometers.

4. The lamp of claim 1, wherein said composite film is substantially transparent to electromagnetic energy having a wavelength in the 600 nanometer region of the electromagnetic spectrum, and is also substantially reflective to the energy having a wavelength greater than 1000 nanometers.

5. The lamp of claim 1 wherein said optimum temperature range comprises temperatures between 1400° K. and 1500° K.

6. The lamp of claim 2, wherein said $TiO_2$ film has a thickness of between 110 nanometers and 130 nanometers.

7. The lamp of claim 2, wherein said $SiO_2$ film has a thickness of between 110 nanometers and 130 nanometers.

8. The lamp of claim 1, wherein said $TiO_2$ and $SiO_2$ films each have a thickness of between 110 nanometers and 130 nanometers, and wherein said $In_2O_3$:Sn film has a thickness of between 130 nanometers and 200 nanometers.

9. The lamp of claim 1, wherein said $TiO_2$ film is about 130 nanometers thick, said $In_2O_3$:Sn film is about 150 nanometers thick, and wherein said $SiO_2$ film is about 120 nanometers thick.

10. A high-pressure sodium lamp, comprising:

an elongate, visible-light-transmissive, pressurizable alumina arc tube having electrodes disposed at the opposite ends thereof for establishment of an ionization discharge therebetween, said arc tube having an inside diameter between 10 millimeters and 25 millimeters;

an atomic sodium metal specie disposed in said arc tube, said sodium metal specie upon excitation responsive to said discharge emitting energy in the visible and infrared wavelengths of the electromagnetic spectrum;

an evacuable, outer glass envelope surrounding said arc tube and having an interior surface facing said arc tube; and a composite IR reflective film deposited upon said interior surface of said outer glass envelope and consisting of a single layer of each of $TiO_2$, $SnO_2$:F and $SiO_2$ films sequentially overlaid on said interior surface of said outer glass envelope, said composite film transmitting a substantial portion of said visible wavelength energy and reflecting toward said arc tube a substantial portion of said infrared wavelength energy which is absorbed by said arc tube in an amount sufficient to maintain the wall temperature of said arc tube in an optimum temperature range.

11. The lamp of claim 10, wherein said $SnO_2$:F film has a thickness of between 80 nanometers and 350 nanometers.

12. The lamp of claim 11, wherein said $SnO_2$:F film has a thickness of between 130 nanometers and 250 nanometers.

13. The lamp of claim 10, wherein said composite film is substantially transparent to electromagnetic energy having a wavelength in the 600 nanometer region of the electromagnetic spectrum, and is also substantially reflective to electromagnetic energy having a wavelength greater than 1000 nanometers.

14. The lamp of claim 1, wherein said optimum temperature range comprises temperatures between 1400° K. and 1500° K.

15. The lamp of claim 11, wherein said $TiO_2$ film has a thickness of between 110 nanometers and 130 nanometers.

16. The lamp of claim 11, wherein said $SiO_2$ film has a thickness of between 110 nanometers and 130 nanometers.

17. The lamp of claim 10, wherein said $TiO_2$ and $SiO_2$ films each have a thickness of between 110 nanometers and 130 nanometers, and wherein said $SnO_2$:F film has a thickness of between 130 nanometers and 250 nanometers.

18. The lamp of claim 10, wherein said $TiO_2$ film is about 130 nanometers thick, said $SnO_2$:F is about 150 nanometers thick, and wherein said $SiO_2$ film is about 120 nanometers thick.

19. The lamp of claim 3, wherein said $TiO_2$ film has a thickness of between 110 nanometers and 130 nanometers.

20. The lamp of claim 3, wherein said $SiO_2$ film has a thickness of between 110 nanometers and 130 nanometers.

21. The lamp of claim 12, wherein said $TiO_2$ film has a thickness of between 110 nanometers and 130 nanometers.

22. The lamp of claim 12, wherein said $SiO_2$ film has a thickness of between 110 nanometers and 130 nanometers.

* * * * *